United States Patent [19]

Provence et al.

[11] Patent Number: 4,997,198

[45] Date of Patent: Mar. 5, 1991

[54] GUIDANCE APPARATUS FOR A CROSS-COUNTRY SKI AND SHOE

[75] Inventors: Marc Provence, Thorens les Glieres; Didier Rousset, Lescheraines; Josiane Dunand, Cran Gevrier, all of France

[73] Assignee: Salomon S.A., Annecy Cedex, France

[21] Appl. No.: 378,033

[22] Filed: Jul. 11, 1989

[30] Foreign Application Priority Data

Jul. 13, 1988 [FR] France ..... 88 09984

[51] Int. Cl.[5] ..... A63C 9/20

[52] U.S. Cl. ..... 280/615; 36/117

[58] Field of Search ..... 280/609, 614, 615, 631, 280/636; 36/117

[56] References Cited

U.S. PATENT DOCUMENTS 4,551,931 11/1985 Bente ..... 36/117
4,735,433 4/1988 Corbet et al. ..... 280/615
4,844,503 7/1989 Dunand ..... 280/615
4,850,609 7/1989 Hue et al. ..... 280/615

FOREIGN PATENT DOCUMENTS 2595578 9/1987 France .
8505557 12/1985 PCT Int'l Appl. .

*Primary Examiner*—Charles A. Marmor
*Assistant Examiner*—Richard Camby
*Attorney, Agent, or Firm*—Sandler, Greenblum & Bernstein

[57] ABSTRACT

A guidance apparatus for a cross-country ski and shoe includes a guidance rib on the ski for cooperation with a complementary groove on the shoe to provide lateral guidance of the shoe. The front portion of the guidance rib is widened to define a support and bearing surface for a journal pin on the shoe. The ribs on the shoe that define the groove are wider at their rear portions to provide support on the ski and for walking.

28 Claims, 2 Drawing Sheets

GUIDANCE APPARATUS FOR A CROSS-COUNTRY SKI AND SHOE

BACKGROUND OF THE INVENTION (1) Field of the Invention

The present invention relates to an apparatus for the lateral guidance of a shoe on a ski, such as a cross-country ski.

(2) Description of Background Relevant Information

A known shoe includes a transverse axle or pin at its front end which is adapted to cooperate with an associated binding on the ski. The binding includes a guidance bearing for the axle to permit the journalling of the shoe on the ski. The ski includes a longitudinal guidance rib which is adapted to cooperate with a longitudinal groove with a complementary shape provided in the sole of the cross-country ski shoe.

An object of the present invention is to improve such a guidance apparatus by improving the guidance of the shoe at the location of the axle, particularly when the shoe is lifted, and to improve the support surface of the shoe on the ski on both sides of the guidance rib.

SUMMARY OF THE INVENTION

According to the present invention, an apparatus is provide for the lateral guidance of a shoe for a cross-country ski of the type having a binding that, in cooperation with the journal pin on the front of the shoe, forms a guidance bearing that effects pivotal movement of the shoe on the ski about the axis of the pin. The apparatus of the invention comprises a longitudinal guide rib on the ski adapted to cooperate with the longitudinal groove of complementary shape in the sole of the shoe. The rib extends towards the front of the ski up to the location of the guidance bearing and has, at the location of the guidance bearing, a widened portion defining a support surface that is transverse to the axis. The support surface constitutes a direct support for the journal pin that defines the axis.

The guide rib may be affixed to the upper surface of the ski or may be integral with the ski. Preferably, the widened portion of the rib has a substantially parallelepiped shape and extends symmetrically on each side of the guide rib. In the preferred construction, the width L of the widened portion is approximately 25% greater than the width l of the rest of the guide rib and corresponds to the active length of the journal pin. In such case, the width of the rear portion of the rib may be a substantially constant value l which may correspond to about half of the width of the ski.

According to the invention, a shoe for cross-country skiing utilizing the guide rib of the invention includes a sole having a longitudinal groove of a shape complementary to the guide rib of the guidance apparatus. Such groove may comprise a front portion of a shape complementary to the shape of the widened portion of the rib, and a rear portion of a shape complementary to the shape of the rear portion of the rib. That is to say, the front portion has a width L, and the rear portion has a width l.

Preferably, the front portion of the groove is defined by spaced, parallel, or substantially parallel side plates that receive the respective axial ends of the journal pin. The rear portion of the groove is defined by two parallel, or substantially parallel, spaced longitudinal ribs on the sole of the shoe. The last mentioned ribs are wider than the spacing between the side plates in transverse dimension whereby the spacing between the plates is greater than the spacing between the two parallel ribs which are adapted to serve as support of for the shoe on the ski.

BRIEF DESCRIPTION OF THE DRAWINGS

Other objects, advantages, and aspects of the invention will become apparent in connection with the following detailed description of the present invention, which is given by way of a non-limiting example together with the accompanying drawings in which.

DETAILED DESCRIPTION OF THE PREFERRED EMBODIMENTS

Figure 1:
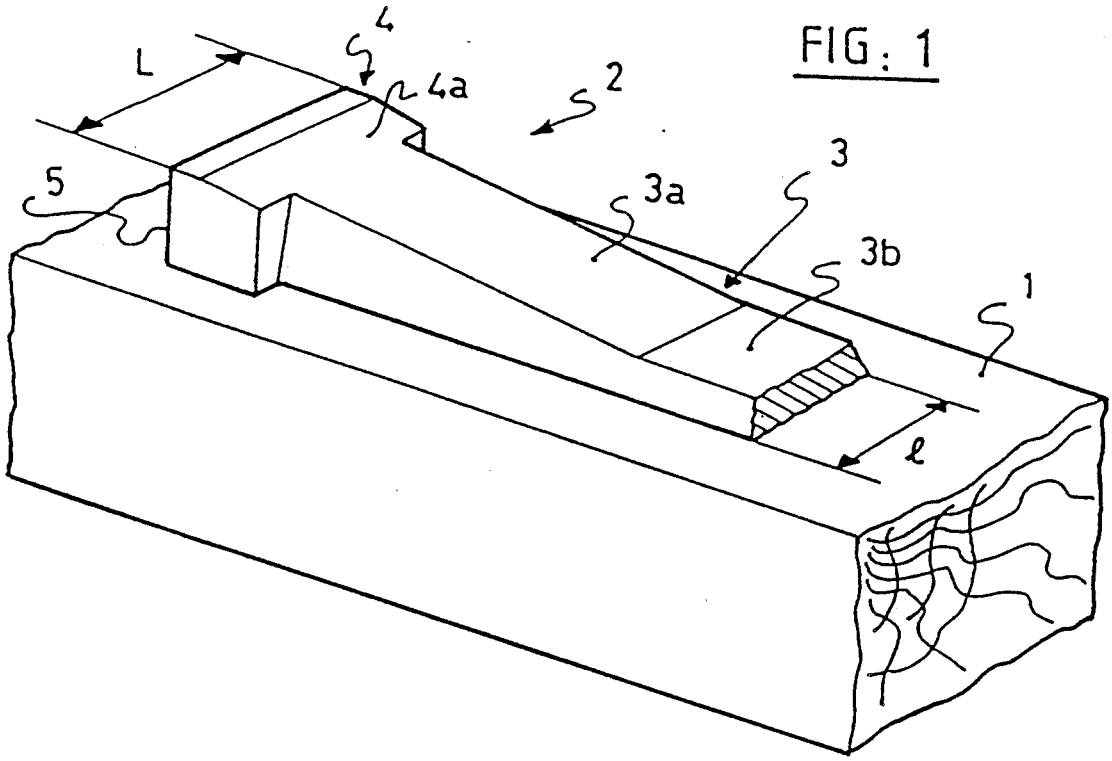
FIG. 1 is a perspective rear view of a guide rib according to the present invention.
Figure 2:
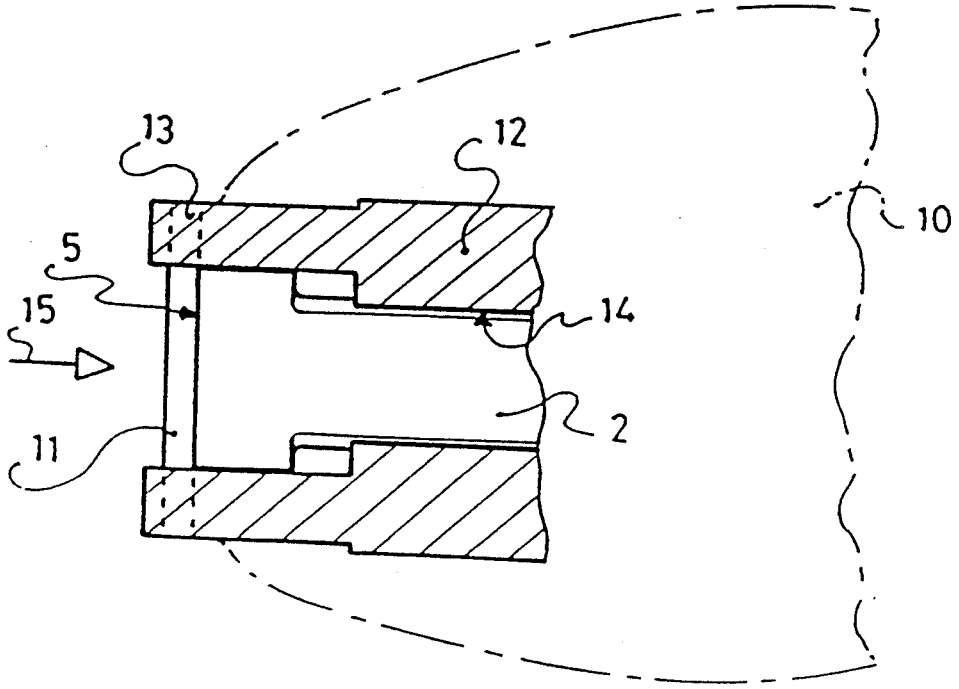
FIG. 2 is a view, partially in cross-section, of the rib shown in FIG. 1, associated with a shoe.

A guidance apparatus according to the invention is shown in FIG. 1 and includes longitudinal guide rib 2 located on the upper surface of the ski 1. As shown in FIG. 2, the guide rib mates with a groove of the sole of the shoe. For purposes of clarity, only the front portions of these two elements are presented in the drawings.

Guide rib 2 comprises first portion 3 having a constant or substantially constant, width l which is generally well-known. In the example shown, portion 3 comprises, at the rear (i.e., towards the right in the drawing), a ramp portion 3*a* followed by horizontal portion 3*b*, where the cross-section of the rib is substantially trapezoidal. Alternatively, first portion 3 of the rib could be constituted entirely by a ramp, or can be totally horizontal, or even have a shape other than trapezoidal.

Portion 3*a* of the rib may be long enough to extend to the rear end of the associated shoe, or can have a length less than that of the shoe. Furthermore, the rib may be fixed to the top of, or made integral with the ski.

At the front of first portion 3, rib 2 comprises widened portion 4 of width L extending up to the location of the guidance bearing (not shown in the drawing) for journal pin 11 defining the axis about which the shoe pivots when in use. Portion 4 has substantially the form of a parallelepiped block and extends symmetrically, or substantially symmetrically, on each side of portion 3. The upper surface of portion 4 may be planar or may be provided with a slight ramp as shown. The slight ramp may be continuous with ramp 3*a*, as shown in FIG. 1.

Front wall 5 of widened portion 4 serves as bearing support for the rotation of the journal pin of the shoe as the latter pivots on the ski. The support furnished by front wall 5 can be direct, as shown in the drawing, or can be made by means of a portion, especially of sheet metal, affixed against the front of wall 5 and constituting a portion of the guidance bearing and adapted to be interposed between this wall and the axis. In the embodiment shown, width L of widened portion 4 corresponds to "the active" length of journal pin 11. That is to say, the active length of the journal pin is the length making bearing contact with wall 5.

Figure 3:
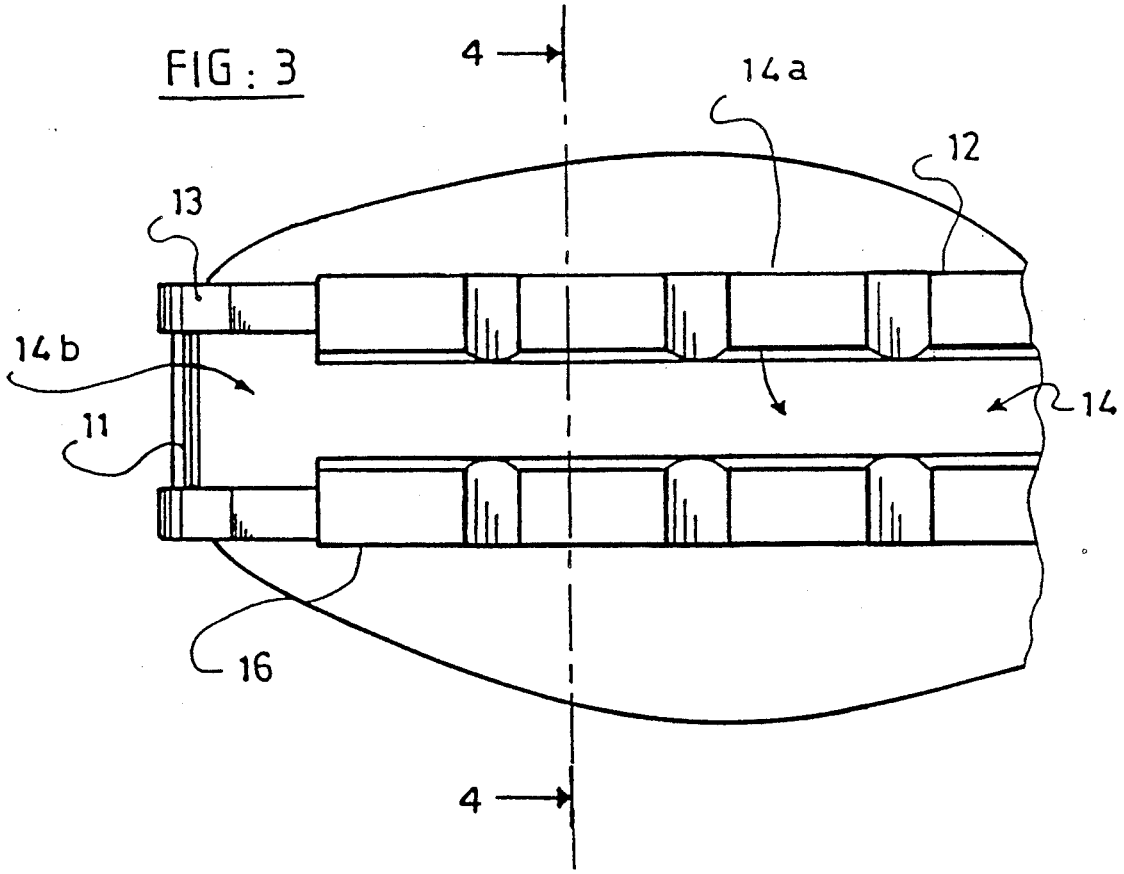
FIG. 3 is a partial view of the bottom of a shoe according to the present invention.

As shown in FIG. 2, the axial ends of journal pin 11 may be affixed to respective side plates 13 of sole 10 of the shoe. These plates extend longitudinally, and the active portion of the pin is thus constituted by the portion thereof located between side plates 13. Plates 13 are parallel, or substantially parallel, and each is constituted by a narrower extension of longitudinal rib 12 of the shoe. Parallel ribs 12 define, between them, groove 14 whose profile, in a known fashion, is complementary to that of rib 3. As shown in FIG. 3, groove 14 in the sole of the shoe extends along the longitudinal axis thereof, and comprises rear portion 14*a* having a trapezoidal cross-section of width l. Portion 14*b* is defined by the two side plates 13 has a width, the widths L and corresponding to the widths L and l of different portions of guide rib 3.

Journal pin 11 is adapted to be moved into engagement with wall 5 of rib 4 in the direction of arrow 15 by the operation of the binding (not shown) which can be constituted in any known manner and thus is not shown further in the drawing. The result is a hinged journal whose rotation axis is constituted by the axis of pin 11. the enlarged width L of widened portion 4 makes it possible to obtain, for the axis of pin 11, a transverse support along its entire active length and thus provides maximum transfer support along its entire active length and thus provides maximum transverse support. Such support reduces significantly the angular deflection of the pin in a transverse direction due to clearances inherent in the manufacture of the various components.

Widened portion 4 of the guide rib thus provides optimum guidance of journal pin 11, and consequently significantly improves the skier's control over the ski.

Figure 4:
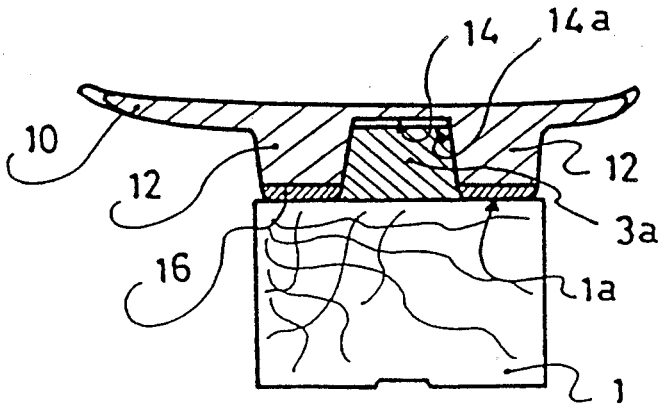
FIG. 4 is a cross-sectional view along the line IV—IV of FIG. 3.

As seen in FIG. 4, width l of portion 3 of the guide rib, and consequently width l of corresponding guide groove 14 provided in sole 10 of the shoe, allows each of ribs 12 on the sole to support the shoe on the ski. The space between ribs 12 is wider than the spacing between the side plates 13 whereby the ribs are adapted to bear on the upper surface of the ski. If guide rib 3 were of constant width L, ribs 12 of the shoe would be too narrow to comfortably support the shoe on the ski.

In the present case, for a ski having a width of approximately 45 mm, width l can be equal to approximately 20 mm, i.e., approximately half the width of the ski which permits support surface 1*a* to have a width on the ski equal to approximately 12.5 mm on each side of portion 3 of the guide rib. Width L of widened portion 4 will preferably be equal to about 25 mm under these circumstances, i.e., approximately 25% greater than the value of width l of the rest of the guide rib.

As shown in FIGS. 3 and 4, the free surface of each rib 12 is provided with walking pads 16 to facilitate walking by the skier, and in order to enhance adherence of the ribs to the skis.

The values of the widths l, L given here, are only indicative. Especially width l, which must be understood as an average width, particularly in the case where a portion of rib 3 has a trapezoidal section. Ribs 3,4 can form, partially, or in integral fashion, a part of the ski binding. Likewise, the ribs can be embodied in one or several parts. Finally, a portion of rib 3 can have a shape different from that as shown, and essentially the invention resides in having the rib with a different width, namely width l and L at different longitudinal positions of the rib. Likewise, the value of rib 3 can correspond to the width of the rib in a rib ski, which allows for the adaptation of the associated shoe for use with such a ski. In such case, the guide rib is constituted by the ski rib.

The present invention is not limited solely to the form of the guidance apparatus shown in the drawings and described above, which is a non-limiting example of an embodiment of the invention, but embraces, on the contrary, all similar or equivalent embodiments.

We claim:

1. Apparatus for the lateral guidance of a shoe for a cross-country ski of the type having a binding that, in cooperation with a journal pin on the front of the shoe, forms a guidance bearing that effects pivotal movement of the shoe on the ski about the axis of the pin, said apparatus comprising:

(a) a longitudinal guide rib on the ski adapted to cooperate with a longitudinal groove of complementary shape in the sole of the shoe, said longitudinal guide rib having a longitudinal axis;

(b) said guide rib extending towards the front of the ski and ending substantially at the position of the guidance bearing; and (c) said guide rib having, at the position of said guidance bearing, a widened guide portion having a support surface for said pin that is transverse to said longitudinal axis.

2. Apparatus according to claim 1 wherein said support surface constitutes a direct support of the journal pin that defines said axis.

3. Apparatus according to claim 1 wherein said support surface constitutes an indirect support of said axis.

4. Apparatus according to claim 1 wherein said guide rib is affixed to the upper surface of the ski.

5. Apparatus according to claim 1 wherein said guide rib is integral with the ski.

6. Apparatus according to claim 1 wherein said widened portion of the rib has a substantially parallelepiped shape.

7. Apparatus according to claim 1 wherein said widened portion extends symmetrically on each side of said guide rib.

8. Apparatus according to claim 1 wherein the width of the widened portion is approximately 25% greater than the width of the rest of the guide rib.

9. Apparatus according to claim 1 wherein the width of the widened portion corresponds to the active length of the journal pin.

10. Apparatus according to claim 1 wherein the width of the rear portion of the rib is substantially constant.

11. Apparatus according to claim 8 wherein the width of the rest of the guide rib is substantially constant.

12. Apparatus according to claim 1 wherein the width of the rear portion of the rib corresponds to about half of the width of the ski.

13. A shoe for cross-country skiing in combination with the apparatus of claim 1 wherein the sole of the shoe has a longitudinal groove of a shape complementary to the guide rib of the guidance apparatus.

14. A shoe according to claim 13 wherein said longitudinal groove comprises a front portion of a shape complementary the shape of the widened portion of the rib, and a rear portion of a shape complementary to the shape of the rear portion of the rib.

15. A shoe according to claim 14 wherein said front portion has a width corresponding to the width of the widened portion of the guide rib, and the rear portion has a width corresponding to the width of the rest of the guide rib.

16. A shoe according to claim 13 wherein said front portion of the groove is defined by spaced parallel side plates in the sole of the shoe.

17. A shoe according to claim 13 including a pair of spaced side plates on the front of the shoe, the respective axial ends of the journal pin being affixed to said side plates.

18. A shoe according to claim 16 wherein said rear portion of the groove is defined by two parallel, spaced longitudinal ribs on the sole of the shoe.

19. A shoe according to claim 18 wherein said longitudinal ribs are wider than said side plates in transverse dimension, whereby the spacing between the plates is greater than the spacing between the two parallel ribs, the ribs being adapted to serve as support for the shoe on the ski.

20. A shoe for cross-country skiing adapted for pivotal movement about an axis on a cross-country ski, said shoe comprising a sole having a longitudinal groove having front and rear portions, adapted to mate with a longitudinal rib on the ski, said sole terminating at approximately the toe of the boot, said groove having a widened front portion with a journal pin extending transversely of a widened front portion.

21. A shoe according to claim 20, said shoe comprising a pair of plates, the respective axial ends of said journal pin being affixed to said plates.

22. A shoe according to claim 20, wherein said front portion of said groove is defined by spaced parallel side plates in the sole of the shoe.

23. A shoe according to claim 22, wherein said rear portion of said groove is defined by spaced parallel longitudinal ribs on the sole of the shoe.

24. A shoe according to claim 23, wherein said longitudinal ribs are wider than said side plates in transverse dimension, whereby the spacing between the plates is greater than the spacing between the ribs, the ribs being adapted to serve as support for the shoe on the ski.

25. Apparatus according to claim 1, wherein said widened portion is integral with the remainder of said rib.

26. Apparatus according to claim 1, wherein said guide rib is generally T-shaped.

27. A shoe according to claim 20, wherein said longitudinal groove is generally T-shaped.

28. A shoe according to claim 22, wherein said journal pin is affixed to said parallel side plates.

* * * * *